United States Patent [19]

Hornsby, Jr.

[11] 4,107,871

[45] Aug. 22, 1978

[54] PROPULSION TOY

[76] Inventor: James R. Hornsby, Jr., 6239 Edgewater Dr., Orlando, Fla. 32810

[21] Appl. No.: 758,782

[22] Filed: Jan. 12, 1977

[51] Int. Cl.[2] ..... A63H 27/00

[52] U.S. Cl. ..... 46/83

[58] Field of Search ..... 46/82, 83, 84, 85, 70, 46/71

[56] References Cited

U.S. PATENT DOCUMENTS

| | | | |
|---|---|---|---|
| 3,473,256 | 10/1969 | Tyler | 46/84 |
| 3,570,467 | 3/1971 | Belokin, Jr. | 124/26 |
| 3,995,392 | 12/1976 | Goldfarb et al. | 46/78 |

FOREIGN PATENT DOCUMENTS

| | | | |
|---|---|---|---|
| 1,153,927 | 1958 | France | 46/83 |

*Primary Examiner*—Louis G. Mancene
*Assistant Examiner*—Mickey Yu

[57] ABSTRACT

A propulsion toy consists of an enlarged disc member, a launching device to which the disc member is attached and a launchable rotor member. The rotor member is disposed forwardly of the disc and releasably engaged with the launching device. When the launching device is operated, the rotor member is set into rapid rotation and the blades thereof react against the foward surface of the disc to thus disengage the rotor member and to permit the same to be propelled forwardly.

4 Claims, 6 Drawing Figures

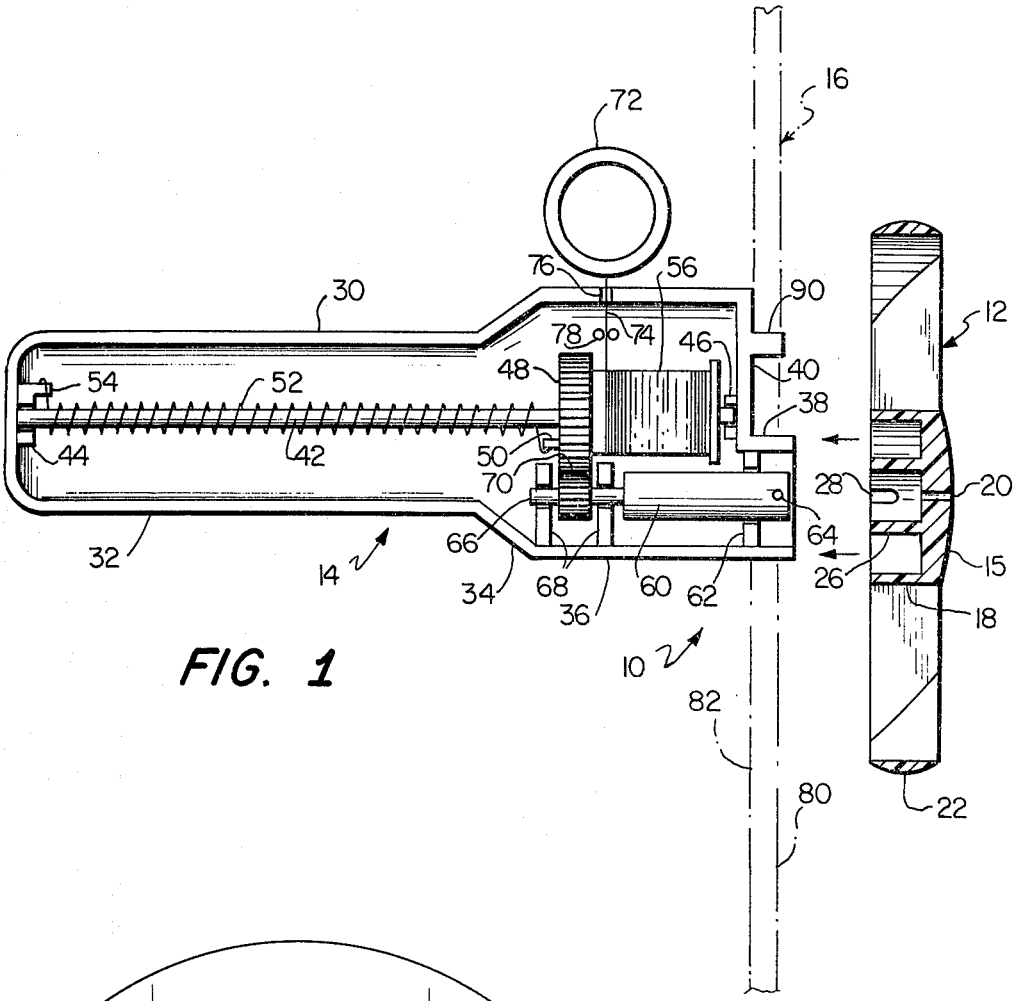
FIG. 1
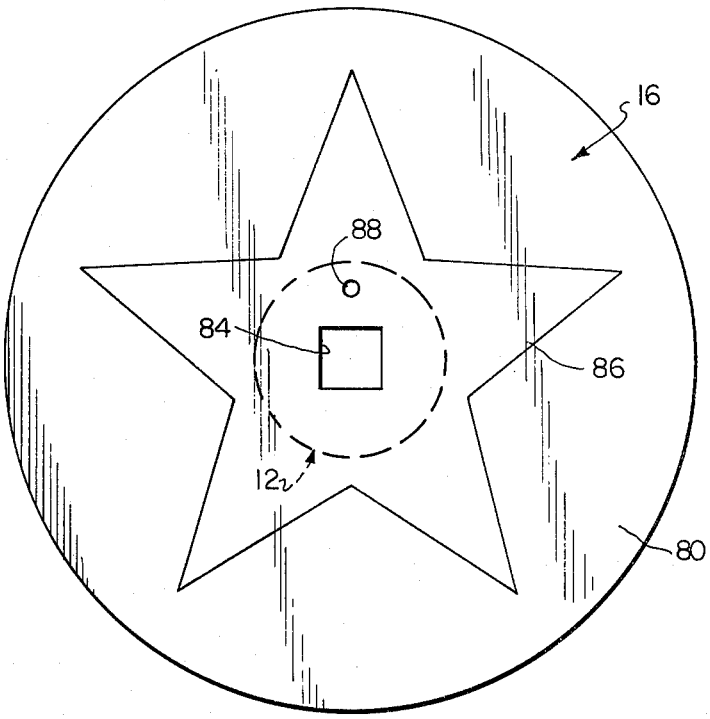
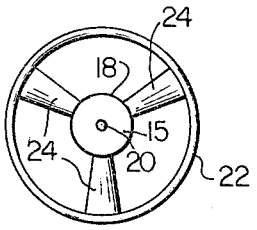
FIG. 2
FIG. 3

PROPULSION TOY

This invention relates to amusement devices and more particularly it relates to an amusement device in the form of a propulsion toy having a member which can be launched by digital operation of the toy.

There are various known forms of propulsion toys ranging from the simplicity of toy slingshots to the complexity of toy rockets. The purpose for all of these toys is to enable the operator to engage in some form of digital manipulation, which, in turn, launches, propels or projects an object through a trajectory in space. The object can be aimed at a particular target, or alternatively, can be launched randomly, simply for the purpose of observing its free flight.

The present invention is directed to a form of propulsion toy which utilizes as a part thereof, an enlarged disc which can function as a shield or which can simply provide decorative indicia thus enabling the user to simulate some particular heroic character or individual.

It is an object of the present invention to provide a new and improved form of propulsion toy.

It is another object of the present invention to provide a unique form of propulsion toy which is relatively inexpensive to produce, yet which is capable of being used multiple times, without failure.

Another object of the present invention is to provide a propulsion toy which is highly attractive to children, yet which is relatively easy and safe to operate.

Other objects, advantages and salient features of the present invention will become apparent from the following detailed description, which, taken in conjunction with the annexed drawings, discloses a preferred embodiment thereof.

The foregoing objects are attained by providing a propulsion toy consisting of the combination of a launchable rotor member, a launching device and an enlarged disc. The rotor member consists of a central portion, an outer rim and a plurality of blade members interconnecting the same, with the blades being disposed at an angle. The launching device consists of a housing having a rotatable member therein and a digitally operable launch element which sets the rotatable member into rapid rotation. An enlarged disc is provided having indicia imprinted on the forward surface thereof and having a central aperture for reception of the forward end of the housing. When the disc is positioned on the housing, the launching device is disposed to the rear of the disc and is hence shielded from visual observation. The rotor member is initially positioned in front of the disc with the central portion thereof being releasably engaged with the rotatable member in the housing. When the digitally operable launch element is operated, thereby setting the rotatable member into rapid rotation, the rotor member is likewise set into rapid rotation. As the rotor member goes into rapid rotation, the blade elements thereon exert air pressure against the forward surface of the disc, which, in turn, disengages the rotor member from the rotating member in the housing. At this point, the rapidly rotating rotor member is propelled or projected away from the disc member by free flight through space.

Referring now to the drawings which form a part of this original disclosure:

FIG. 1 is a longitudinal sectional view showing in diagrammatic form a propulsion toy in accordance with the principles of the present invention;

FIG. 2 is a front elevational view of the rotor member;

FIG. 3 is a front elevational view of the disc member;

Figure 4:
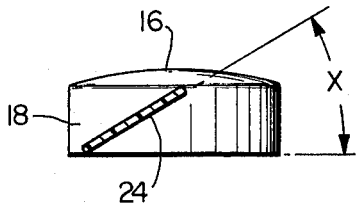
FIG. 4 is a fragmentary sectional view of the rotor member.

Referring now to the drawings in further detail, the propulsion toy of the present invention is shown in FIG. 1 and is generally designated 10. The propulsion toy 10 includes a launchable rotor member generally designated 12, a launching device generally designated 14 and an enlarged disc generally designated 16.

Considering first the rotor member 12, as shown in FIGS. 1 and 2, such rotor member includes a central portion including a forward dome 15 having an annular skirt 18 formed integrally therewith and extending rearwardly therefrom. A small aperture 20 is formed in the center of the dome 15. The rotor 12 also includes an outer rim 22 which concentrically surrounds the central portion but is spaced therefrom. A plurality of blade members 24 extend between and are integrally connected with the skirt portion 18 and the rim 22. In the illustrated embodiment of FIG. 2, three such blade members 24 are shown, with the members being spaced apart from each other by 120°.

As illustrated in FIG. 4, the blades 24 are disposed angularly and hence provided with a certain pitch. The pitch angle is designated $x$ in FIG. 4 and the value of this angle is between about 15° and about 30°.

A tubular projection 26 extends rearwardly from the central dome portion 15 of the rotor member as shown in FIG. 1. This tubular projection 26 is concentrically disposed within the annular skirt 18 and is fully surrounded thereby. A pair of opposed slots 28 are formed in the projection 26 for purposes to be described hereinafter.

Referring once again to FIG. 1, it will be seen that the launching device 14 includes a housing or casing 30, preferably formed in two identical longitudinally divided halves which can be interconnected together in any suitable manner to form a closed housing. In FIG. 1, only one-half of the casing 30 is shown. For convenience of description, the rear or smaller portion of the casing which forms a handle for the launching device 14 can be designated 32. The housing 30 flares outwardly at 34 to form an enlarged portion 36. The enlarged portion 36 in turn has a forward end portion 38 which fits into the disc member in a manner to be described hereinafter. The forward surface of the casing beyond which the forward end portion 38 projects is designated 40.

Within the housing or casing 30, there is provided an elongated shaft 42. The rear end of the shaft is journaled in a support 44 formed at the rear end of the casing while the forward end of the shaft is journaled in a similar support 46 formed on the interior of the forward wall 40 of the housing or casing. The shaft 42 carries a drive gear 48 which is disposed in the enlarged portion 36 of the housing. A pin 50 extends rearwardly from the drive gear 48, such pin being disposed eccentrically with respect to the shaft 42. A torsion spring 52 surrounds the shaft 42. One end of the torsion spring is hooked upon and engaged with the pin 50 on the drive gear 48. The opposite end of the spring 52 engages with a hook 54 formed on the shaft support 44. A drum 56 is fixedly attached to and carried by the shaft 42 forwardly of the drive gear 48.

The launching device includes a rotatable body or member 60 disposed partially within the enlarged portion 36 of the casing and partially within the forward end portion 38 thereof. The casing includes an internal support 62 formed in the forward end portion 38 of the housing and into which the rotatable member 60 fits. At the forward end of the rotatable member 60, there is provided a pair of outwardly projecting pins or ears 64, which are adapted to interfit with the slots 28 in the rotor.

A stub shaft 66 extends rearwardly from the rotatable body 60 and is journaled within supports 68 within the casing. The stub shaft 66 carries a driven gear 70 which meshes with the drive gear 48. The driven gear 70 is of a smaller diameter than that of the drive gear 48 with an advantageous ratio of the sizes being 3:1.

A digitally operable launch element in the form of a finger engageable ring 72 is provided as a part of the launching device 14. The ring 72 is attached to a cord or cable 74 which fits through an aperture 76 in the casing wall, passes between a pair of guide pins 78 and wraps about the winding drum 56.

To understand the nature of the launching device thus far described, it will be understood that when the ring 72 is digitally grasped and pulled upwardly, such pulling action causes rotation of the drum 56, the drive gear 48 and the shaft 42. The rotation of the gear 48 is in turn imparted to the driven gear 70 which rotates the stub shaft 66 and the rotatable body 60 attached thereto. When the ring element 72 is released, the action of the torsion spring 52 causes the drum 56 to rewind or wind in the opposite direction to wrap the cord 74 back thereonto. Such movement, of course, also causes opposite directional movement of the drive gear 48 and the driven gear 70 and the parts connected thereto.

Considering now the disc 16, such disc consists of an enlarged circular member having a forward surface 80 and a rearward surface 82. The disc includes a central aperture 84 configured to receive the forward end portion 38 of the housing 30. Ornamental and decorative indicia 86 is imprinted on the forward surface 80 of the disc member 16. Additionally, a small guide hole 88 is provided in the disc member slightly above the central aperture 84 therein. The purpose of this guide hole 88 is to receive a small pin 90 which projects forwardly from the forward surface 40 of the casing. The insertion of the projecting pin 90 in the guide hole 88 and the insertion of the forward portion 38 of the housing in the central aperture 84 of the disc serves to assure that there will be no relative rotation between the disc 16 and the launch device 14.

Figure 5:
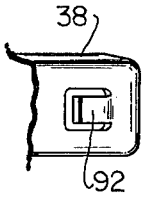
FIG. 5 is a fragmentary prospective view of the forward portion of the housing.

As shown in FIG. 5, the forward projecting portion 38 on the housing is preferably of a square configuration. Along the sides of the square, a pair of integrally formed ears 92 are provided. These ears can flare outwardly slightly but are free to cam inwardly as they are pushed through the central aperture 84 in the disc. The ears 92 serve to assure a further tight engagement between the disc and the launch member.

To understand the operation of the invention, it will be appreciated that the three separate parts 12, 14 and 16 can be engaged with one another or separated, as desired. To place the propulsion toy 10 in condition for usage, the disc 16 is positioned with its rear surface 82 facing the forward surface 40 on the launch device 14. Then, these two parts are moved relative to each other until the forward end portion 38 on the launch device housing fits into and through the central aperture on the disc. At the same time, the forwardly projecting pin 90 should fit through the guide hole 88 on the disc. Once this occurs, the disc is mounted upon and hence carried by the launch device 14. Then, the rotor member is positioned as shown in FIG. 1 and moved rearwardly until the projecting portion 26 thereof fits within the forward end portion 38 of the housing. The projecting ears 64 on the rotatable body 60 of the launch device fit into the slots 28 formed on the rotor. When this interfitting occurs, the rotor is positioned flush against the forward surface 80 of the disc and is supported and carried centrally by means of its engagement with the forward end portion of the launch device.

Figure 6:
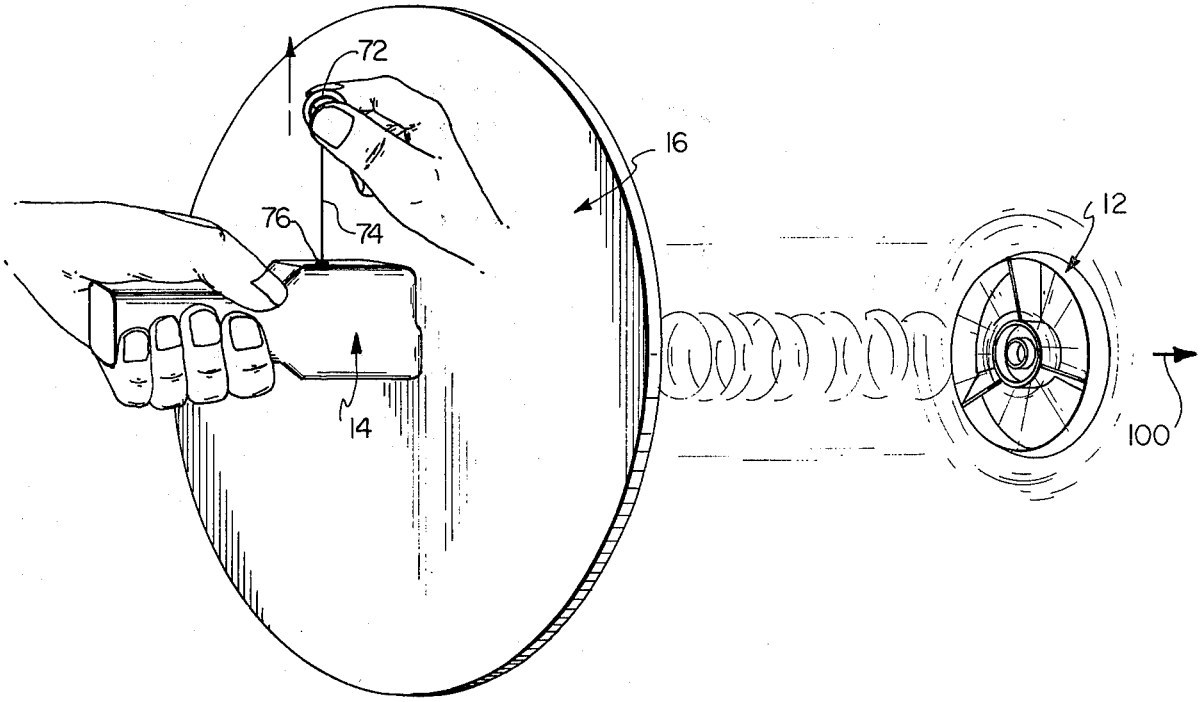
FIG. 6 is a diagrammatic prospective view showing the manner of operation of the propulsion toy.

Because the diameter of the disc 16 is considerably greater then the diameter of the rotor 12, as is illustrated in FIG. 3, and because the diameter of the disc 16 is preferably greater than one foot, both the launch device 14 and the operator's hands which hold the launch device are hidden from view by means of the disc 16. The operator holds the portion 30 of the housing in his hand, as illustrated in FIG. 6, and he thereby supports not only the launch device 14, but also the disc 16 and the rotor 12 which are attached thereto. When the operator desires to launch or propel the rotor, he simply grasps the ring element 72 and pulls the same sharply upward in the manner illustrated in FIG. 6. This sharp upward pulling will cause a rapid rotation of the rotatable member 60 in the manner previously described. As the body 60 rotates, the rotor member 12 which is attached thereto likewise rotates rapidly. This rapid rotation causes the blade members 24 to exert air pressure against the forward surface 80 of the disc. The degree of air pressure exerted will depend upon the particular pitch of the blade members 24. In any event, when the air pressure reaches a sufficient magnitude, which occurs very rapidly, the rotor member is urged forwardly thereby disengaging the slots 28 therein from the projecting ears 64 on the rotating body 60 within the launch device. As such, the rotor 12 is propelled forwardly, as shown by the arrow 100 in FIG. 6. The speed at which the rotor 12 rotates at least partially controls the distance it will travel. The direction in which it travels, as illustrated by the arrow 100 in FIG. 6, is determined primarily by its initial orientation. Thus, if the user holds the launch device, disc and rotor in an upward direction, the rotor 12 will be propelled upwardly. If he holds it in a downward direction, the rotor will be propelled downwardly, and so on. The speed of rotation is controlled primarily by the gearing 48 and 70 and by the length of the operating cord 74. After the operator has launched the rotor 12 as shown in FIG. 6, he can simply release the launch ring 72 whereupon the launching device will automatically be restored to its initial condition through operation of the torsion spring 52. Then, the operator can either recover the launched rotor 12 or simply use a new rotor 12, attach the same in the manner previously described, and the propulsion toy is ready for another operation.

Various changes and modifications apparent to those skilled in the art can be made without departing from the spirit and scope of the present invention as defined in the claims hereinafter.

What is claimed is:

1. A propulsion toy amusement device comprising the combination of:

a launchable rotor member;

a launching device; and an enlarged disc removably disposed between said rotor member and said launching device;

said rotor member including a central portion, a rim concentrically surrounding said central portion and blade members interconnecting said central portion and said rim;

said launching device including a housing having a forward end portion, a rotatable body within said housing extending at least partially within said forward end, and a digitally operable launching element for rapidly rotating said rotatable body;

said enlarged disc having a central aperture therein configured for reception of said housing forward end portion and into which said housing forward end portion extend thereby mounting said disc upon said launching device;

said rotor member being initially positioned in substantially abutting engagement with the forward surface of said enlarged disc and being retained in such initial position by engagement of said rotor central portion with that portion of said rotatable body which extends into the forward end of said housing;

said blades on said rotor member having their rear edges disposed in substantial abutment with said disc forward surface when said rotor member is in its initial position;

said rotor member being launched by digitial operation of said launch element which sets said rotatable body and engaged rotor member into rapid rotation whereby air pressure exerted by said rotating blade members is directed against said disc to cause said rotor member to disengage from said rotatable body and to be propelled forwardly in space while spinning rapidly;

said disc having a diameter substantially greater than the diameter of said rotor member to thereby shield and secret the launching device from the view of an observer in front of said amusement device in order to prevent such observer from seeing the launching operation;

said central aperture and said housing forward end portion being non-circular;

said disc including a guide hole formed therein adjacent to said central aperture and said housing having a forwardly projecting pin which extends through said guide hole, said disc thereby being removably secured to said housing in a manner which prevents said disc from rotating relative to said housing.

2. A device as defined in claim 1 wherein ornamental and decorative indicia are provided on the forward surface of said disc.

3. A device as defined in claim 1 further including a pair of movable flared members on opposite sides of said housing forward end portion, said flared members engaging against the rear surface of said disc to create a tight engagement between said disc and said launching device.

4. A propulsion toy amusement device comprising the combination of:

a launchable rotor member;

a launching device; and an enlarged disc removably disposed between said rotor member and said launching device;

said rotor member including a central portion, a rim concentrically surrounding said central portion and blade members interconnecting said central portion and said rim;

said launching device including a housing having a forward end portion, a rotatable body within said housing extending at least partially within said forward end, and a digitally operable launching element for rapidly rotating said rotatable body;

said enlarged disc having a central aperture therein configured for reception of said housing forward end portion and into which said housing forward end portion extends thereby mounting said disc upon said launching device;

said rotor member being initially positioned in substantially abutting engagement with the forward surface of said enlarged disc and being retained in such initial position by engagement of said rotor central portion with that portion of said rotatable body which extends into the forward end of said housing;

said blades on said rotor member having their rear edges disposed in substantial abutment with said disc forward surface when said rotor member is in its initial position;

said rotor member being launched by digital operation of said launch element which sets said rotatable body and engaged rotor member into rapid rotation whereby air pressure exerted by said rotating blade members is directed against said disc to cause said rotor member to disengage from said rotatable body and to be propelled forwardly in space while spinning rapidly;

said disc having a diameter substantially greater than the diameter of said rotor member to thereby shield and secret the launching device from the view of an observer in front of said amusement device in order to prevent such observer from seeing the launching operation; said launching device including:

(a) a first gear connected to said rotatable body;

(b) a second gear engaged with said first gear and serving as a drive gear for said first gear;

(c) a drum connected between said second gear and the forward end of said housing;

(d) a shaft connected between said second gear and the rear end of said housing;

(e) said shaft and said rotatable body being disposed in parallel axes;

(f) a return spring surrounding said shaft, engaged at its rear end to the rear end of said housing and engaged at its forward end to said second gear; and (g) an operating cord wound upon said drum and connected with said launch element;

said operating cord, when pulled by digital operation of said launch element, causing said drum and said second gear to rotate rapidly with such rotation being transmitted to said first gear and said rotatable body to thereby cause said rotatable body to rotate rapidly;

said return spring being operable to rewind said cord onto said drum when said launch element is released.

* * * * *